United States Patent [19]

Buckland

[11] Patent Number: 4,516,274

[45] Date of Patent: May 14, 1985

[54] ADJUSTABLE EARCUP RETENTION HARNESS

[75] Inventor: Bruce E. Buckland, Franklin, Mass.

[73] Assignee: The United States of America as represented by the Secretary of the Army, Washington, D.C.

[21] Appl. No.: 573,902

[22] Filed: Jan. 26, 1984

[51] Int. Cl.[3] ..... A42B 1/06

[52] U.S. Cl. ..... 2/209; 2/6; 2/423

[58] Field of Search ..... 2/209, 423, 6

[56] References Cited

U.S. PATENT DOCUMENTS

| | | | |
|---|---|---|---|
| 3,005,203 | 10/1961 | Aileo | 02/209 X |
| 3,400,406 | 9/1968 | Aileo | 2/209 X |
| 3,470,564 | 11/1967 | Aileo | 2/423 |
| 3,530,509 | 9/1970 | Simpson et al. | 2/209 |
| 3,619,814 | 12/1971 | Aileo | 2/418 |

*Primary Examiner*—Werner H. Schroeder
*Assistant Examiner*—J. L. Kravitz
*Attorney, Agent, or Firm*—Anthony T. Lane; Robert P. Gibson; Mark Goldberg

[57] ABSTRACT

A flexible harness for holding earcups in position about the ears of the wearer which extends from one side of the wearer's head around the neck to the other side of the head. The harness, which is secured within a rigid protective helmet, has two U-shaped end portions and a nape portion. Drawstrings are sewn onto each side of each U-shaped end portion and are connected to the opposing length of drawstring by an adjustable fastener. The drawstrings engage a channel on the periphery of each earcup and allow for the vertical and rotational adjustment in the position of the earcup.

5 Claims, 3 Drawing Figures

ADJUSTABLE EARCUP RETENTION HARNESS

The invention described herein may be manufactured, used, and licensed by or for the Government for governmental purposes without the payment to me of any royalty thereon.

This invention relates to a novel adjustable earcup retention harness to be used with headgear for protecting the head of the wearer. The adjustable earcup retention harness serves to position sound attenuating earcups within the headgear and in a comfortable sound attenuating engagement about the ears of the wearer.

Headgear providing sound attenuation are employed to shield the ears of the wearer from sound levels which would be uncomfortable, prevent communication or be injurious. Sound attenuation is normally provided by surrounding the ear with a rigid earcup adapted to completely enclose the wearer's ears. The periphery of the earcup is provided with a yieldable pad adapted to engage the wearer's head, along a region extending entirely around the ear. The earcup is constructed so that the yieldable pad exerts sufficient pressure in all areas in which it contacts the wearer's head, yet low enough in all areas so that the earcup may be worn comfortably. The earcups are normally secured to headgear, such as helmets or to headbands within helmets, which hold the earcup in position over the ears of the wearer. Various means have been used for the purpose of holding earcups in position. U.S. Pat. No. 3,470,564, incorporated herein by reference, shows a safety helmet in which a flexible shield or harness is employed to hold sound attenuating earcups. The earcups are held inside inwardly concave ear covering portions on the shell. A shield or harness of flexible material, extending around the nape of the neck to the other side of the head, encircles the earcups at both sides of the helmet. The shield is attached by bolts cooperating with nuts to the helmet shell. There is an adjustable strap which allows an adjustment in the length of the harness where it contacts the back of the neck. Biasing straps are provided which are used to adjustably bias the earcup against the ear. The adjustments in the harness provide some capacity to fit individuals with heads of different dimensions. However, there is no provision for earcup height adjustments or rotational adjustment to accommodate the wearer's ears. The manner in which the earcup is held in place makes it difficult to remove and install earcups.

U.S. Pat. No. 3,619,814, incorporated herein by reference, shows essentially the same harness used in U.S. Pat. No. 3,470,564. The main difference is that instead of the harness being one continuous piece, there are two essentially mirror image pieces. The nape portion of the harness has two separable, overlapping pieces which are attached by a pair of cooperating, complimentary, pressure-actuable surface contact fastening elements. These elements permit adjustment of the amount of overlap so as to keep the nape portion from bunching up when its effective length is reduced by adjustment of the strap and buckle.

It has been found that earcups having smaller openings are more efficient to attenuating noise. However, in order to design earcups with small openings it is necessary to have a high degree of adjustability about the wearer's ears. The needed degree of adjustability is what the present invention provides.

SUMMARY OF THE INVENTION

According to the present invention an adjustable earcup retention harness is provided which fits within headgear, such as rigid helmet shells. The helmet shell has downwardly depending, inwardly concave side portions which extend over and cover the ears of the wearer. Between these ear covering portions of the shell and the wearer's head are earcups, which are provided with yieldable pads around their periphery. These pads are the only parts of the earcup intended to touch the wearer's head. The earcups are suspended from the helmet shell by means of a flexible harness supported from the shell.

The present invention lies in the means for suspending the earcups. As in the past, a harness extending around the nape of the neck of the wearer is used to hold the earcups in place. However, instead of encircling the earcups, the cloth harness has horseshoe or U-shaped segments in the areas where it contacts or secures the earcups. The open end of the U-shaped segment is oriented upwardly, toward the crown of the helmet shell. Drawstrings are secured onto each inside upwardly extending edge of the U-shaped areas so that a length of each drawstring lies both above and below the harness. Each length of drawstring engages a channel on an earcup and is connected or secured to the opposing length of drawstring laterally across the U-shaped opening by an adjustable fastener. This means for holding the earcups in place provides for adjustability in the position of the earcup, both in vertical and angular or rotational directions. Horizontal adjustment of the earcup is provided at the nape strap of the harness. In addition, the earcup may be more easily installed and removed from this harness than from the harness disclosed in the prior art.

DETAILED DESCRIPTION

A helmet shell and the rigging means for supporting the shell on the head of the wearer may be seen in U.S. Pat. No. 3,619,814 entitled Protective Helmet with Adjustable Headband. The harness designated generally as 14 (referred to as a shield in the above patent) used in the present invention includes eyelets which correspond to the eyelets in the shield described in U.S. Pat. No. 3,619,814 allowing it to be attached to the helmet in an identical manner. Other means of attaching the harness to helmets or other headgear as known in the art could be employed.

The helmet used with the present invention may be identical to that described in U.S. Pat. No. 3,619,814 or some other headgear or protective helmet. The helmet consists of a generally conventional rigid protective helmet molded, for example, of glass fiber-reinforced plastic or the like. The helmet is adapted to receive the head of the wearer and has a crown portion shaped to extend over the crown and rear of the wearer's head, as well as two opposed inwardly concave side portions which depend from the crown portion in position to extend over the wearer's ears.

Figure 1:
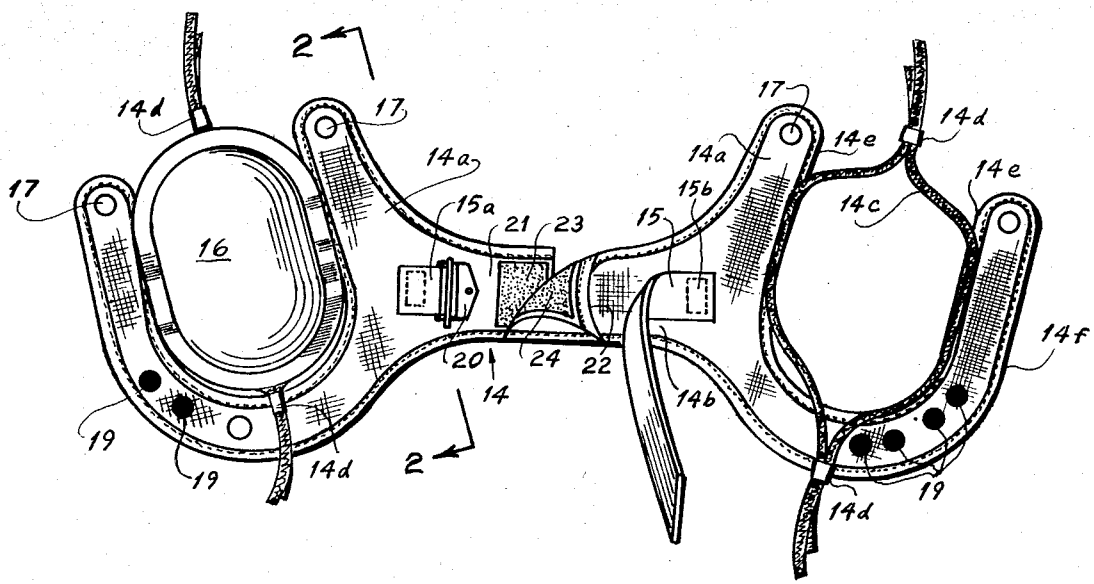
FIG. 1 is a view of the harness structure of this invention.
Figure 2:
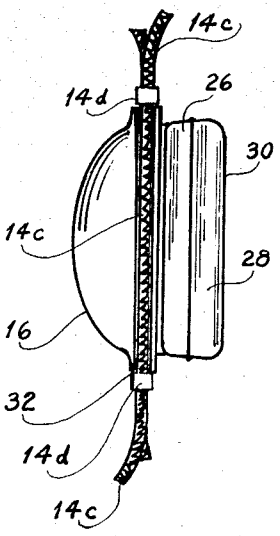
FIG. 2 is a side view in elevation of the earcup held in place by means of drawstrings, with portions of the harness above and below the earcup not shown.
Figure 3:
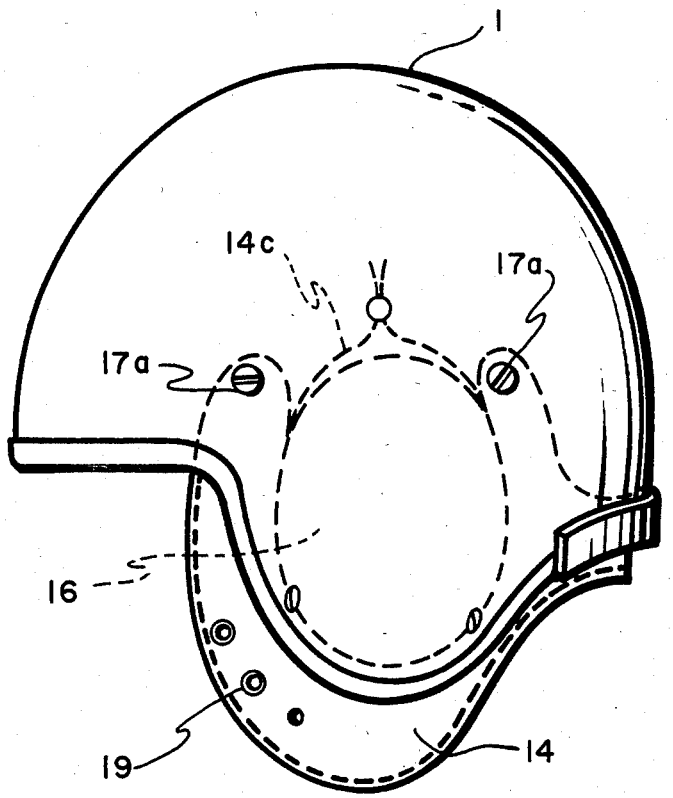
FIG. 3 is a side view of a helmet which has mounted in it a harness holding an earcup in place.

Within the concave side portions of the helmet as shown in FIGS. 1-3 of U.S. Pat. No. 3,619,814 are disposed a pair of sound attenuating earcups 16 of conventional character, each comprising an outwardly domed earcup shell having an elliptically annular flange 26 defining a recess 28 for receiving and enclosing an ear of a wearer, with an internal lining of sound-deadening material and a resiliently compressible annular seal 30 mounted on the flange for engaging the wearer's head in surrounding relation to his ear. The general construction of such earcups is well known in the art and accordingly need not be described in detail. The earcup bears a channel 32 around the perimeter by which it engages the harness in the manner described below.

In the structure shown in FIG. 1 herein, earcups 16 may be mounted in opposed end portions 14*a* of a flexible harness 14, which may be fabricated of textile materials or other suitable materials. Harness 14 also includes a nape portion 14*b* connecting the two end portions 14*a* and extending around the nape of the wearer's neck. Shown in FIG. 1 is one earcup 16 secured to the harness with the other earcup receiving opening left empty for illustrative purposes. The harness 14 may be suspended within the interior of a helmet shell by means of posts and screws, not shown, that pass through eyelets 17 in the ends of U-shaped portions of the harness. The earcups are respectively disposed in the concave side portions of the helmet shell in position to receive the wearer's ears. Harness end portions 14*a* may bear a plurality of snap fastener grommets or like elements 19 for mounting a chin strap (not shown) to engage the wearer's chin and thereby to aid in holding the helmet fixed in position on his head. Several of elements 19 may also be used for mounting an oxygen or gas mask.

End portions 14*a* of the harness 14 are separable and are connected by both a strap 15 and cooperating complementary pressure actuable surface fastening elements sold under the tradename Velcro pads at the nape portion. Strap 15 is stitched at one end to the rearwardly facing surface of the harness nape portion 14*b* at 15*b*. Nape portion 14*b* at 15*a* bears a buckle 20 adapted to grip the free end of the strap 15, the strap being adjustable in the buckle to vary the effective length of the nape portion 14*b* (i.e. between the localities of attachment of the strap and buckle) to conform to the wearer's head. The nape portion 14*b* comprises two separable, overlapping pieces 21 and 22 respectively bearing on their facing surfaces a pair of cooperating complimentary pressure-actuatable surface contact fastening elements 23 and 24, e.g. elements of the hook and loop type, commercially available under the tradename "Velcro." These elements detachably secure piece 21 to piece 22 in overlapping relation and permit adjustment of the amount of overlap so as to keep the nape portion from bunching when its effective length is reduced by adjustment of the strap 15 and buckle 20.

The end portions 14*a* are U-shaped or horseshoe-shaped. The U-shaped areas have an inner edge 14*e* and an outer edge 14*f*. Each end portion is provided with two separate drawstrings 14*c* which are sewn into each of the inner edges 14*e* of the U-shaped area. Portions of each drawstring 14*c* extend above and below the portion of drawstring 14*c* sewn to inner edge 14*e*. Drawstrings 14*c* are slideably fastened together above and below the U-shaped portion by adjustable cord locks 14*d*, so as to allow the position of each earcup to be vertically adjustable to fit the wearer. The end of each drawstring has a knot or some other means not shown to prevent the adjustable cord lock from completely coming off of the drawstring. The drawstrings 14*c* when joined together by the cord locks 14*d* form a loop whose size and position may be adjusted by moving the cord locks 14*d*. The adjustable cord locks 14*d* may be made of any material which will retain its position on the drawstrings, except when the wearer pulls the cord lock firmly along the drawstring 14*c*. The cord locks 14*d* may be made of a short segment of plastic or metal tubing or any other configuration which will serve the desired purpose. A substitute for the cord lock could be to join the opposing drawstrings with knots. However, the knots would not offer the ease of adjustability afforded by the cord locks.

FIG. 3 is a sideview of a helmet which has the harness held in place by two fasteners 17*a* which go through eyelets 17 shown in FIG. 2. The outline of earcup 16 is shown held in place by drawstrings 14*c*. A portion of harness 14 extends below the helmet and provides fasteners 19 for attaching gear such as chinstraps.

The operation of this invention may be best understood by reference to FIG. 1 and FIG. 2. An earcup 16, equipped with a channel 32 around its periphery, is held in place by drawstrings 14*c*. The drawstrings 14*c* in conjunction with a portion of the inner edges 14*c* of the U-shaped end portions are seated within channel 32 and encircle the earcup. The position of the earcup into or out of the U-shaped area i.e., in an essentially vertical direction can be controlled by pulling the adjustable cord lock 14*d* in the desired direction and then tightening the opposite cord locks to hold the earcup firmly in the desired vertical position. The use of the drawstrings also allows the wearer to adjust the angular or rotational relationship of the earcup to the wearer's ear without loosening the adjustable cord locks. Although rotation of the earcup may result in some distortion of the cloth harness, any such distortion does not interfere with the functioning of the harness as intended.

Although the use of drawstrings has been specified, various types of cords or ribbons may be employed to hold the earcup in place. Other modifications will readily occur to those skilled in the art and therefore the invention is limited only by the appended claims.

I claim:

1. A flexible harness adapted to be secured to a rigid protective helmet adapted to receive the head of a wearer, said harness having two U-shaped end portions located so as to partially encircle the ears of the wearer, said U-shaped end positions connected by means of a nape strap, means attached to said U-shaped end portions to hold earcups in position so as to cover the ears of the wearer, said means permitting rotational and vertical adjustment of the position of the earcups to cover the ears of the wearer.

2. A flexible harness according to claim 1 wherein said means consists of drawstrings partially attached to said U-shaped end portions of said harness and forming a loop which surrounds and engages said earcups.

3. A flexible harness according to claim 2 wherein said drawstrings are each held respectively by one of two essentially opposed and parallel sides of each end portion, so that each opposed drawstring has one end extending above the harness and one end below the harness, each of said ends extending above the harness and each of said ends extending below the harness, being adjustably secured together across the U-shaped portion by adjustable cord locks.

4. A flexible harness according to claim 3 wherein said drawstrings are sewn onto the inner edge of the U-shaped end portions.

5. A flexible harness according to claim 4 wherein said drawstrings engage channels on said earcups, said channels encircling said earcups.

* * * * *